United States Patent [19]

Mott et al.

[11] Patent Number: 4,688,527

[45] Date of Patent: Aug. 25, 1987

[54] CERAMIC VALVE GUIDE AND SEAT

[75] Inventors: Donald H. Mott, Mount Clemens; Howard Schmidt, Pontiac, both of Mich.

[73] Assignee: Chrysler Motors Corporation, Highland Park, Mich.

[21] Appl. No.: 846,181

[22] Filed: Mar. 31, 1986

[51] Int. Cl.[4] ..... F01L 3/02

[52] U.S. Cl. ..... 123/188 AA; 123/188 S; 123/188 GC; 123/188 VA

[58] Field of Search ..... 123/188 AA, 188 S, 188 GC, 123/188 VA

[56] References Cited

U.S. PATENT DOCUMENTS

| | | | |
|---|---|---|---|
| 1,086,216 | 2/1914 | Raclot et al. | 123/188 S |
| 1,091,963 | 3/1914 | Riedl | 123/188 S |
| 1,235,816 | 8/1917 | Kytlica | 123/188 S |
| 3,728,994 | 4/1973 | Bachle | 123/188 GC |
| 4,008,695 | 2/1977 | Bouquet | 123/41.76 |
| 4,200,066 | 4/1980 | Berchtold | 123/188 S |
| 4,341,185 | 7/1982 | Pozzet | 123/188 GC |
| 4,494,500 | 1/1985 | Hansen | 123/190 E |
| 4,554,898 | 11/1985 | Yamada et al. | 123/188 S |
| 4,556,022 | 12/1985 | Yamada et al. | 123/188 S |
| 4,570,585 | 2/1986 | Hayashi | 123/188 S |

FOREIGN PATENT DOCUMENTS

| | | | |
|---|---|---|---|
| 3318899 | 11/1984 | Fed. Rep. of Germany | 123/188 GC |
| 616333 | 1/1927 | France | 123/188 GC |
| 78119 | 6/1980 | Japan | 123/188 GC |

*Primary Examiner*—Ira S. Lazarus

*Attorney, Agent, or Firm*—Kenneth H. MacLean, Jr.

[57] ABSTRACT

For inclusion within a cast metal cylinder head for an internal combustion engine, a ceramic valve seating and stem supporting integral device for supporting and sealingly interacting with a conventional engine poppet-type valve. The integral valve seating portion has an annularly shaped valve seat defining a circular configuration for sealing engagement with the poppet-type valve. The valve supporting portion is of tubular configuration. Also included are connecting ceramic portions between the valve seat forming portion and the valve stem supporting portion. The device is integrally cast together to form a unit for subsequent inclusion within the metal cylinder head of the internal combustion engine by casting. Resultantly, the axis of the tubular valve support portion ispositioned normal to the plane of the annular valve seat and its circular valve seat surface and with the axis of the tubular support portion being coaxially aligned with the axis of the valve seat portion.

2 Claims, 7 Drawing Figures

CERAMIC VALVE GUIDE AND SEAT

BACKGROUND OF THE INVENTION

Many current engines manufactured by auto makers use aluminum cylinder heads for a number of reasons, including weight reduction for the engine. Currently, these aluminum cylinder heads are fitted with iron base valve guides and valve seats to provide necessary wear and heat resistance and also desired sealing with the commonly used poppet-type valves. The poppet-type valves have an elongated stem portion with a circular cross-section and an enlarged head portion attached to the stem portion. The valves cannot operate directly in an aluminum head in contact with the aluminum because of the softness of the aluminum material and its low melting point.

In utilizing iron base valve guides and valve seats in an aluminum or other metal type head, the hole for the valve guide which supports the valve stem is very accurately drilled and machined so as to be coaxial with the circular valve seating portion formed by the separate valve seat member. In this regard, the valve seat member is normally of hardened iron base material and when attached to the cylinder head, it is first cooled as by insertion in liquid nitrogen and then inserted into the cylinder head. Subsequently, the valve seat must be finish machined on its inside diameter to ensure accurate coaxial alignment with the valve stem supporting hole in the guide and to ensure good sealing with the head of the poppet-type valve. This is the process by which valve guides and seat portions are assembled and finished in all engines known to applicant.

It has been known previously to cast valve guide or valve seat components within a cylinder head. The U.S. Pat. No. 4,570,585 to Hayashi shows a sheet metal formed valve seat which is embedded in the block or cylinder head by casting the cylinder head around the valve seat insert. It has also been known to form an integral valve seat and stem guide for valving in internal combustion engines. The U.S. Pat. No. 4,008,695 to Bouquet discloses a one-piece metal valve seat and stem guide structure with integral cooling chambers therein. This type of device, called a valve chest in the patent, is known to have been used in diesel engine construction.

It has also been known to use ceramic materials for components in an internal combustion type engine. In U.S. Pat. No. 4,494,500 to Hansen, a rotary sleeve type seal of ceramic material is disclosed. This structure is quite dissimilar to the normal poppet-type valving arrangement for internal combustion engines.

SUMMARY OF THE INVENTION

The subject application discloses a particular use of ceramic material for an integrally formed valve seat and valve support structure for an internal combustion engine of the type using poppet-type valves. The valve support and seat structure consists of an annularly shaped valve seat forming portion which is cast of ceramic material, a tubularly shaped valve stem support structure of ceramic material and connecting portions therebetween also of ceramic material. The portions including the seat forming portion and the stem supporting portion are integrally molded with the connecting portions aligning the other two portions so that the axis of the stem supporting portion is normal to the valve seat forming portion and the two portions are coaxial. The ceramic structure is then cast in place with a cylinder head preferably of easily cast material such as aluminum. The metal material of the cylinder head is made to encircle the stem supporting portion and the connecting portions and to extend about the annular seat forming portion. Once the one-piece ceramic structure is supported by casting with the cylinder head, there is very little, if any, machining which must be carried out on the valve stem supporting and valve seat forming structure.

In accord with the foregoing description, it is clear than an object of the subject invention is to form a one-piece ceramic structure combining a valve stem guiding portion and a valve seat forming portion in a cast metal cylinder head.

A further object of the subject invention is to provide an integral valve supporting and valve seat forming structure of ceramic material so constructed so that the valve supporting portion is accurately aligned with the valve seat forming portion so as to require little or no additional action once the structure is cast into the engine cylinder head.

A still further object of the subject invention is to provide an integral valve supporting structure of ceramic material consisting of a valve seat forming portion, a valve stem supporting portion and connecting portions, the valve stem portion and the connecting portions may be embedded by casting into the metal cylinder head while the valve seat portion is encircled by the metal of the cylinder head during the casting process to rigidly secure these portions to the cylinder head in proper alignment for operative engagement with a conventional poppet-type engine valve.

Further advantages and objects of the invention will become clearer from a reading of the following detailed description, reference being had to the accompanying drawings in which preferred embodiments of the invention are illustrated in detail.

IN THE DRAWINGS

DETAILED DESCRIPTION OF AN EMBODIMENT

Figure 1:
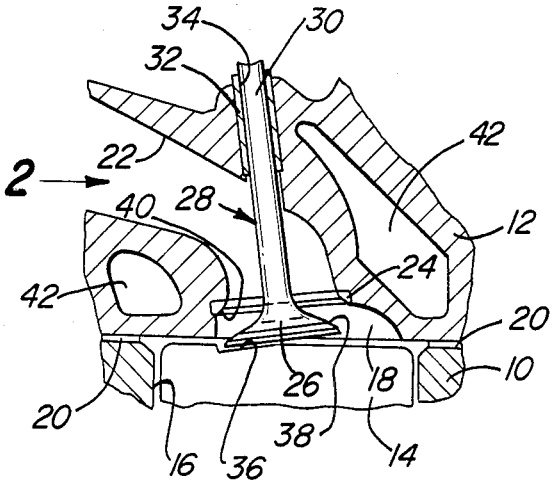
FIG. 1 is an elevational, partially sectioned view of an engine in the vicinity of a cylinder chamber showing the subject valve support and seat forming structure cast into a cylinder head.
Figure 2:
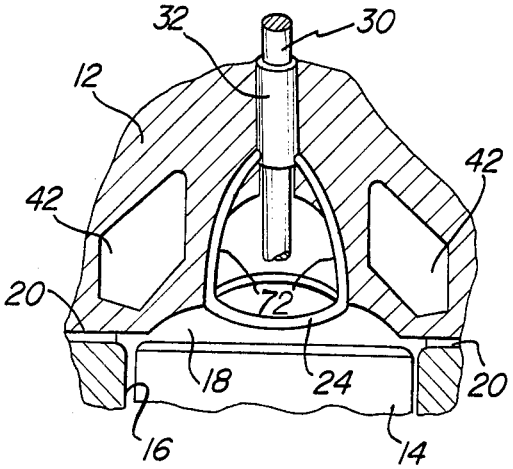
FIG. 2 is a sectioned view looking in the direction of arrow 2 in FIG. 1 with portions of the cylinder head and engine block broken away to reveal the cast-in structure of the valve support and seat forming member.
Figure 3:
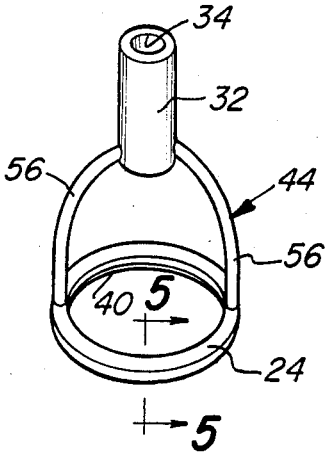
FIG. 3 is a perspective view of the integral valve support and seat forming portion as cast in ceramic material.
Figure 4:
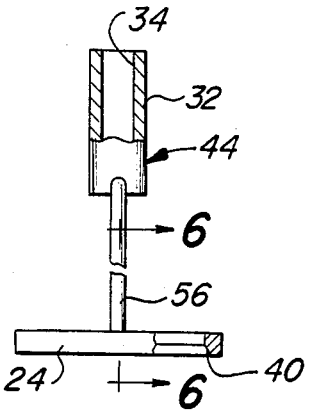
FIG. 4 is a side elevational view of the integral structure shown in FIG. 3 with portions broken away to reveal interior structure.

In FIGS. 1 and 2, a partial view of an engine combustion chamber is shown including an engine block 10, a cylinder head assembly 12, and a piston 14. Piston 14 is adapted to reciprocate within a cylinder bore 16 within the block 10 in a conventional manner. The cylinder head assembly 12 is joined to the cylinder block 10 to form a combustion chamber 18 and is separated by means of a gasket 20. The cylinder block assembly 12 is connected firmly to the block 10 by means of a plurality of fasteners (not shown).

In FIGS. 1 and 2, an air/fuel intake passage 22 formed in the cylinder head assembly 12 is illustrated for inducting fluid into the combustion chamber 18. As is known in engine operation, the movement of the piston 14 draws the fluid into the combustion chamber 18 past a valving arrangement. Specifically, the valving arrangement includes an opening into the combustion chamber 18 formed by an opening thereto encircled by a valve seat member 24 which is of annular configuration. In FIG. 1, the valve seat portion 24 is separated from an enlarged head portion 26 of an opened poppet-type valve 28. The poppet-type valve 28 is conventionally used in internal combustion engines and includes the enlarged head portion 26 which is connected to an elongated cylindrical stem portion 30. The stem portion 30 is supported within a stem guide 32 which is surrounded by portions of the cylinder head assembly 12. An interior bore 34 in the guide 32 is sized to closely encircle the stem portion 30 of the valve 28 so that movement of the valve member 28 is established in a direct linear movement (up and down in FIG. 1). The reciprocation of the stem portion 30 within the guide portion 32 causes the enlarged head portion 26 to move toward and away from the piston 14. In FIG. 1, the valve 28 is shown in its fully open position. The cutaway channel portion 36 in the face of the piston 14 accommodates any downward movement of the enlarged head portion 26 of valve 28. The head portion 26 includes an accurately ground inclined surface 38 thereabout which mates with a valve seating surface 40 in the annular portion 24. When the valve 28 is moved upward from the open position shown in FIG. 1 so that the enlarged head portion 26 engages the seat portion 24, the combustion chamber 18 is sealed from the passage 22 so that air/fuel no longer can flow into the combustion chamber. In FIGS. 1 and 2, the spaces or open passages 42 are water coolant passages through which the engine coolant may flow to prevent overheating of the cylinder head assembly 12.

Figure 5:
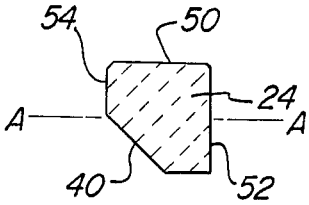
FIG. 5 is an enlarged sectional view taken along section line 5—5 in FIG. 3 and looking in the direction of the arrows.

In FIGS. 3–6, details of the specific embodiment of the subject integral valve seat and valve stem forming device 44 are illustrated. Specifically, the device 44 is cast of ceramic material to be described more specifically hereinafter. The device 44 includes the valve seat forming portion 24, as in FIGS. 1 and 2, which has an annular configuration with an inclined seating surface 40 thereon adapted to receive the surface 38 of the movable poppet-type valve 28. The device 44 also includes tubular portion 32 also of ceramic material with an interior bore 34 adapted to receive the elongated cylindrical stem portion 30 of valve 28. As shown in FIG. 5, the valve seating surface 40 is inclined at approximately 45 degrees with respect to the plane A of the annular valve seat forming portion 24. Also, the upper surface 50 and outer annular surface 52 are adapted to be engagingly encircled by adjacent portions of the cast cylinder head assembly 12 as shown in FIG. 1. The inner diameter surface 54 partially defines the passage for air/fuel fluid passing into the combustion chamber 18 as shown in FIG. 1. Referring back to FIG. 4, the portions 24 and 32 of the apparatus 44 are integrally connected by ceramic connector or strap means 56 which are integrally connected to the top surface 50 of the portion 24. The connecting portions 56 may be of the same material as portions 24 and 32 and are integrally cast or embedded into the metal of the cylinder head 12 shown in FIG. 1. The connecting portions 56 may have a circular cross-section as shown or may be of any other desirable cross-sectional configuration. The connecting portions 56 generally extend perpendicular to the plane A of the annular member 24, but are curved inward to integrally join with the lower part of the tubular valve stem supporting portion 32. Although only a pair of connectors 56 are shown in the drawings, it is contemplated that more than two connectors may be utilized, it being realized that the prime significance of the connectors 56 is to secure portions 24 and 32 together in an exacting aligned relationship so that the axis of the bore 34 is perpendicular to the plane A of the annular portion 24 and also coaxial with the axis of the annularity 24, and specifically, the seating surface 40.

Figure 7:
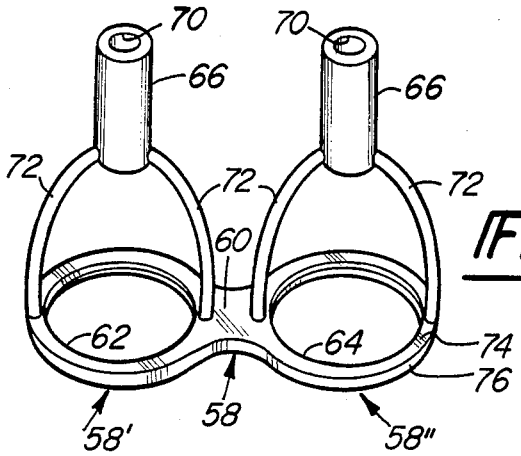
FIG. 7 is a perspective view of a modification to the structure shown in FIG. 3.
Figure 6:
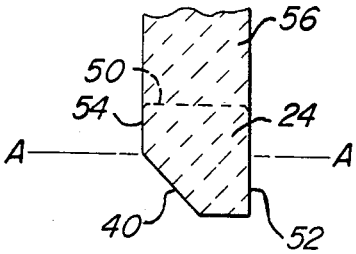
FIG. 6 is an enlarged sectional view taken along section line 6—6 in FIG. 4 and looking in the direction of the arrows.

In FIG. 7, a second embodiment of the integral valve stem guide and valve seat is shown. Specifically, a valve seat forming structure 58 is illustrated in the form of two circular or annular portions 58' and 58'' connected by a central portion 60. The valve seat forming structure has two side-by-side circular surfaces 62 and 64 which correspond to the surface 54 of the embodiment shown in FIGS. 1–6. Although not readily visible in FIG. 7, the underside of the valve seat forming member 58 has two valve seat forming surfaces similar to the surface 40 shown in FIGS. 5 and 6. The structure in FIG. 7 also includes a pair of valve stem guiding tubular portions 66 both essentially the same as the similar structure 32 shown in FIGS. 1–4. Both tubular portions 66 include a bore 70 for receiving an elongated cylindrical stem 30 of a poppet valve 28. Likewise, the tubular portion 66 are connected to the valve seat forming portion 58 by a plurality of integral connectors 72 which are essentially the same as the connecting means 56 shown in FIGS. 3 and 4. As with the first embodiment, it is adapted to be cast in ceramic material and subsequently supported in a mold for casting with the cylinder head assembly out of metal such as aluminum. Resultantly, the tubular portion 66 and the connectors 74 will be embedded in the metal cylinder head structure as shown in FIGS. 1 and 2. Likewise, the valve seat forming portion 58 is partially encircled on the upper surface 74 and the outward surface 76 into the metal cylinder head assembly. The connecting portion 72 of the embodiment shown in FIG. 7 perform the same function as the connecting portions 56 in the first embodiment in that they connect the tubular portion 66 with the valve seat forming portion 58 and coaxially align the axes of bore 70 with the opening 72 and 64 as well as establishing a perpendicular or normal relationship between the axes of bores 70 and the plane of the valve seat forming portion 58.

Although two embodiments of the invention have been illustrated in the drawings and described in detail heretofore, other modifications of the invention may be easily contemplated which fall within the scope of the following claims which describe the invention.

We claim:

1. For molded inclusion in a cast metal cylinder head of a internal combustion engine, an integral ceramic valve seat and valve stem guide assembly for operative engagement with and support of a conventional poppet-type valve with its enlarged head portion with a sealing surface thereon and an elongated cylindrical stem portion, comprising:

valve seat forming means cast in ceramic material having an annular configuration operatively conforming to the configuration of the sealing surface of the valve and defining an annular seating surface for sealing engagement with the enlarged valve head when the valve is in a closed position;

valve stem support means cast in ceramic having a generally tubular configuration with an internal bore and defining a support for reciprocation of the cylindrical stem portion of the valve as the valve moves between open and closed operative position;

connecting means cast in ceramic and integral with both the valve seat forming means and the valve stem supporting guide means for aligning the means so that a plane through the annular seating surface is normal to the axis of the tubular guide means and coaxially supporting the annular valve seat forming means and the tubular guide portion whereas the integral valve seat forming means, valve stem guide means and connecting means are included during the casting formation of the metal cylinder head to form an aligned valve seating and supporting structure.

2. For molded inclusion in a cast metal cylinder head of an internal combustion engine, an integral ceramic valve seat and stem guide assembly for operative engagement with and support of a commonly used poppet-type valve of the type having an enlarged head with an annular seal surface thereon and an elongated stem portion, comprising:

valve seat forming means of ceramic having an annular configuration conforming to the seal surface configuration of the valve's enlarged head and further defining an annularly configured seating surface for sealing engagement with the valve when in its closed position;

tubular valve stem support means of ceramic defining an internal bore for reciprocally supporting the valve's stem portion;

integral connecting means of ceramic between the seat forming means and the stem support means in the form of a plurality of spaced distinct strap portions whereby the strap portions are embedded in the cast metal structure of the cylinder head with a fluid flow passage formed between at least one pair of strap portions as further defined by the cylinder head;

the strap portions being formed with the seat forming means and the stem support means so that the axis of the stem support means is established normally to a plane of the seat forming means and further the axis of the stem support means is coaxial with the axis formed by the annular seating surface of the seat forming means whereby machining of the assembly after being formed within the cylinder head is greatly decreased.

* * * * *